US008167541B2

(12) United States Patent
Park et al.

(10) Patent No.: US 8,167,541 B2
(45) Date of Patent: May 1, 2012

(54) VIBRATION-ABSORBING DEVICE FOR BLOWER MOTORS

(75) Inventors: Jun Kyu Park, Hwaseong-si (KR); Jun Mo Ku, Hwaseong-si (KR)

(73) Assignees: Hyundai Motor Company, Seoul (KR); Kia Motors Corporation, Seoul (KR); Halla Climate Control Corp., Daejeon (KR)

( * ) Notice: Subject to any disclaimer, the term of this patent is extended or adjusted under 35 U.S.C. 154(b) by 707 days.

(21) Appl. No.: 12/336,334

(22) Filed: Dec. 16, 2008

(65) Prior Publication Data

US 2009/0285672 A1 Nov. 19, 2009

(30) Foreign Application Priority Data

May 16, 2008 (KR) ..... 10-2008-0045323

(51) Int. Cl.

| | |
|---|---|
| ***F01D 25/04*** | (2006.01) |
| ***F01D 25/00*** | (2006.01) |
| ***F04D 29/44*** | (2006.01) |
| ***F04B 35/00*** | (2006.01) |
| ***F04B 17/00*** | (2006.01) |

(52) U.S. Cl. ..... 415/119; 415/204; 415/121.2; 417/363; 417/423.7

(58) Field of Classification Search ..... 415/119, 415/204, 213.1, 192, 191, 206, 182.1, 208.1, 415/210.1, 208.2, 121.2; 417/363, 423.7, 417/247 R See application file for complete search history.

(56) References Cited

U.S. PATENT DOCUMENTS

| | | | | |
|---|---|---|---|---|
| 6,435,818 | B1 | 8/2002 | Gatley, Jr. | |
| 2006/0018575 | A1 * | 1/2006 | Yum et al. | 384/106 |

FOREIGN PATENT DOCUMENTS

| | | | |
|---|---|---|---|
| JP | 11-252852 | A | 9/1999 |
| JP | 2007-189812 | A | 7/2007 |

* cited by examiner

*Primary Examiner* — Chuong A. Luu

(74) *Attorney, Agent, or Firm* — Morgan, Lewis & Bockius LLP

(57) ABSTRACT

Disclosed herein is a vibration-absorbing device for blower motors, which is provided between a blower motor and a motor housing surrounding the blower motor. The vibration-absorbing device includes a vibration-absorbing body, which may be spherical, and an engaging depression. The vibration-absorbing body is provided in the blower motor. The engaging depression is formed in the inner surface of the motor housing such that a vibration-absorbing body can be contained therein.

8 Claims, 3 Drawing Sheets

VIBRATION-ABSORBING DEVICE FOR BLOWER MOTORS

CROSS-REFERENCE TO RELATED APPLICATION

This application claims priority to Korean Application No. 10-2008-0045323 filed May 16, 2008, the entire contents of which application is incorporated herein for all purposes by this reference.

BACKGROUND OF THE INVENTION

1. Field of the Invention

The present invention relates generally to a vibration-absorbing device for a blower motor, which is used to absorb vibration and noise generated by the blower motor.

2. Description of Related Art

A typical vehicle air conditioning system includes an air intake unit for introducing and transmitting external air, a compressor for compressing refrigerant, a condenser for condensing refrigerant, an expansion valve for decompressing the liquid refrigerant, and a heat exchanger for performing heat exchange with the external air through variation of the phase of the refrigerant.

In the vehicle air conditioning system, the air intake unit transfers the air, which is introduced through the air inlet of a casing, to the heat exchanger by rotating a blower fan in response to the operation of a blower motor. However, vibration and noise occur due to the operation of the blower motor. In order to solve this problem, the air intake unit may be provided with an O-ring for absorbing vibration therein.

However, conventionally, the O-ring mitigates the vertical vibration but not the forward, backward or lateral vibration of the blower motor.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

The various embodiments of the present invention provide for a vibration-absorbing device that can absorb vertical, forward, backward and/or lateral vibrations produced by a blower motor.

Various embodiments of the invention provide for a vibration-absorbing device for a blower motor, the vibration-absorbing device being provided between the blower motor and a motor housing surrounding the blower motor, the vibration-absorbing device including a vibration-absorbing body provided in the blower motor, and an engaging depression formed in an inner surface of the motor housing and containing the vibration-absorbing body.

An aspect of the present invention is directed to a vibration-absorbing device for a blower motor, the vibration-absorbing device being provided between the blower motor and a motor housing surrounding the blower motor. The vibration-absorbing device may include a vibration-absorbing body provided in the blower motor, and/or an engaging depression formed in an inner surface of the motor housing and containing the vibration-absorbing body.

The vibration-absorbing body may be mounted so as to protrude from a part of an outer surface of the blower motor. The engaging depression may be formed to have a shape that corresponds to the outward shape of the vibration-absorbing body, which is pressed and inserted into the engaging depression.

The device may include a plurality of vibration-absorbing bodies that are spaced apart from each other and are disposed along an outer circumference of the blower motor. The vibration-absorbing body may include a first absorption ball, a second absorption ball, and/or a connection unit for connecting the first and second absorption balls to each other. The blower motor may include a support bracket into which the connection unit is fitted.

The vibration-absorbing body may be spherical.

Other aspects of the present invention are directed to a blower motor housing including the above-mentioned vibration-absorbing devices, and to a blower motor assembly including a blower motor and the above-described blower motor housings.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
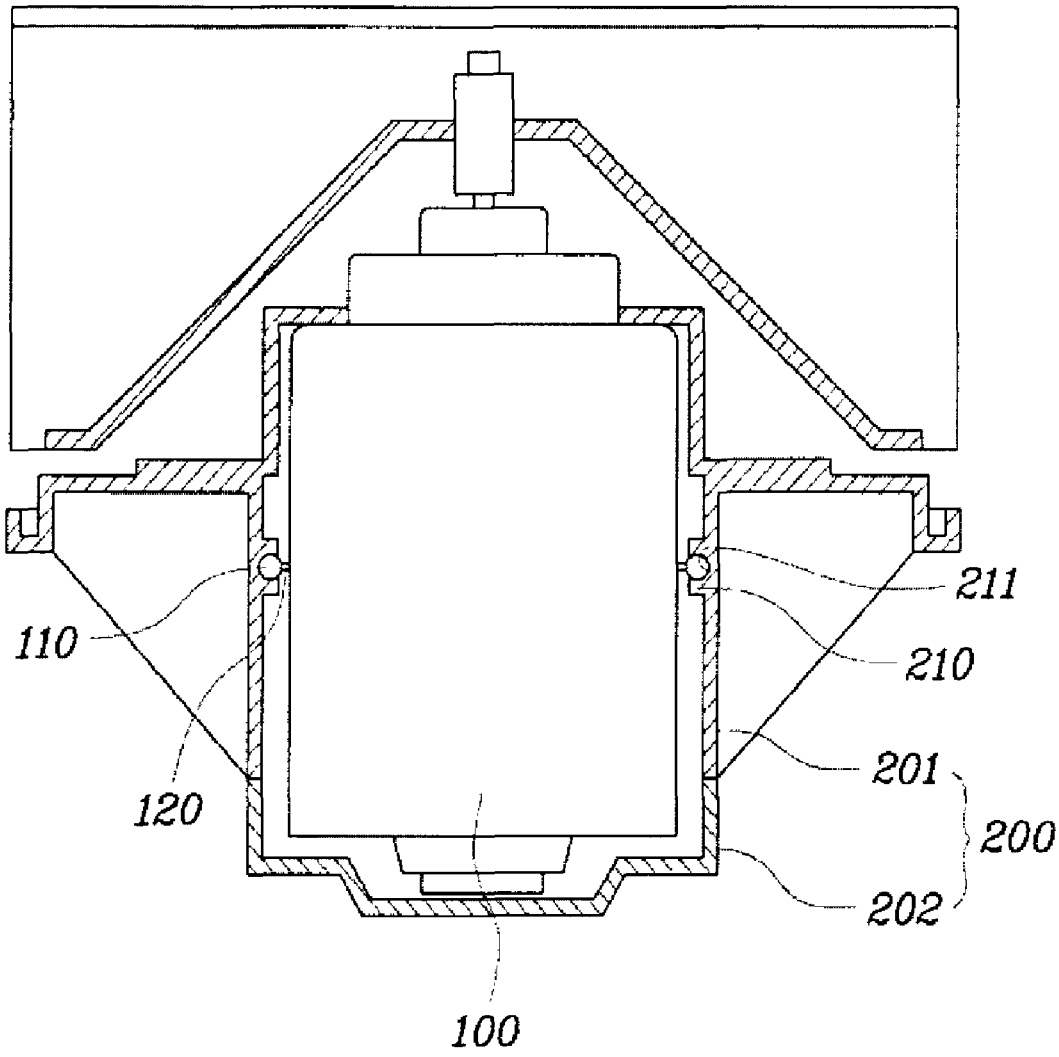
FIG. 1 is a view showing the construction of an exemplary vibration-absorbing device for a blower motor, according to various aspects of the present invention.

As shown in FIG. 1, a blower fan for introducing external air to an air-conditioning system is connected to and operates in conjunction with a blower motor 100. The blower motor 100 is mounted in a motor housing 200, which may include an upper motor housing 201 and a lower motor housing 202. A vibration-absorbing device for a blower motor according to various embodiments of the present invention is provided between the blower motor 100 and the motor housing 200.

In various embodiments, the construction of a blower fan, the blower motor 100, and the motor housing 200 may be similar to that of a blower fan, a blower motor, and a motor housing used in a typical air-conditioning system, detailed descriptions of which are omitted.

In some aspects, the vibration-absorbing device is provided with spherical vibration-absorbing bodies 110 between the blower motor 100 and the motor housing 200. In this and other aspects, all kinds of vibration of the blower motor 100 are effectively absorbed.

In greater detail, the vibration-absorbing device includes spherical vibration-absorbing bodies 110, which are provided in the blower motor 100, and engaging depressions 210, which are formed in the inner surface of the motor housing 200 so as to contain the respective vibration-absorbing bodies 110.

The vibration-absorbing bodies 110 are made of material that can absorb or mitigate the vibration of the blower motor 100. In various embodiments, the vibration-absorbing bodies 110 may be made of elastic material such as rubber; however, other elastic material including but not limited to polyurethane or plastic may also be used.

Figure 3:
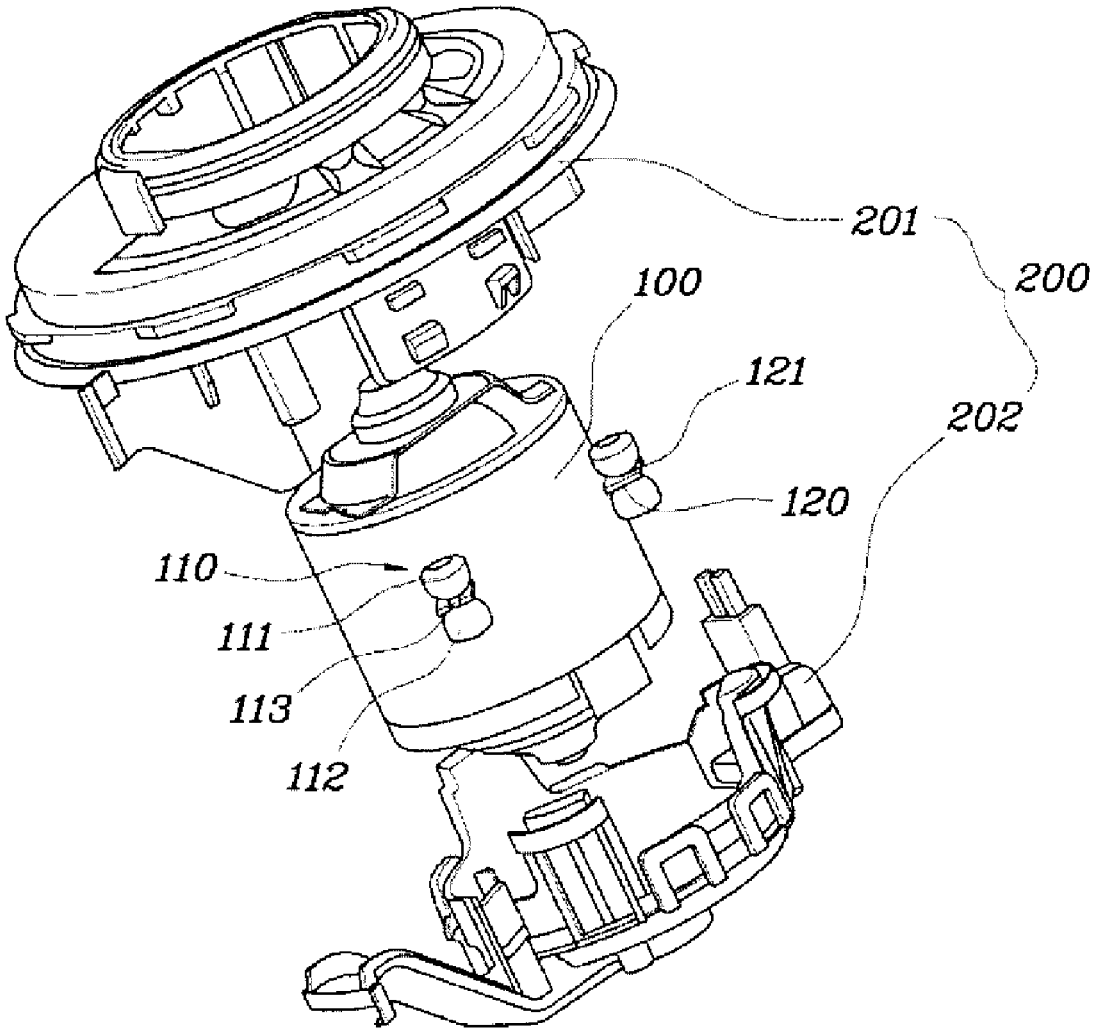
FIG. 3 is an exploded perspective view showing an exemplary vibration-absorbing device according to various aspects of the present invention.

The vibration-absorbing bodies 110 may be fastened to the blower motor 100 via separate support brackets 120. The support brackets 120 are assembly means for fastening the respective vibration-absorbing bodies 110, and as shown in FIG. 3, have respective fitting depressions 121, into which the vibration-absorbing bodies 110 are fitted.

The vibration-absorbing bodies 110 may have a spherical shape, and are fastened to the blower motor 100. In some aspects, it is not necessary that the vibration-absorbing bodies 110 be perfect spheres, and it is sufficient if they have a shape that is formed to have a curved surface. The reason for this is because all kinds of vibration of the blower motor 100 can be mitigated or absorbed by the spherical vibration-absorbing bodies 110.

That is, when many kinds of vibration, such as vertical, forward and backward, and lateral vibration, are generated by the blower motor 100, the spherical vibration-absorbing bodies 110, which are fastened to the blower motor 100, are contained in the respective engaging depressions 210 of the motor housing 200 so as to be in complete contact with the engaging depressions 210, so that all of the different kinds of vibration of the blower motor 100 can be absorbed or mitigated by the vibration-absorbing bodies 110.

In some aspects of the invention, in order to effectively mitigate the vibration of the blower motor 100, a plurality of vibration-absorbing bodies 110 is spaced apart from each other and is disposed along the outer circumference of the blower motor 100. In some aspects of the invention, three vibration-absorbing bodies 110 may be disposed along the outer circumference of the blower motor 100. Where a plurality of vibration-absorbing bodies 110 is disposed along the outer wall of the blower motor 100 at regular intervals as described above, they are attached to the motor housing 200 in a balanced manner and the lateral vibration of the blower motor 100 can be effectively mitigated.

In some aspects, the engaging depressions 210 may be formed in the inner surface of the motor housing 200, and may have shapes that correspond to the outer shapes of the vibration-absorbing bodies 110. These engaging depressions 210 contain the respective vibration-absorbing bodies 110 while contacting the outer surfaces of the respective vibration-absorbing bodies 110. Accordingly, when the blower motor 100 vibrates, the engaging depressions 210 restrict the motion of the vibration-absorbing bodies 110, so that the vibration of the blower motor 100 can be mitigated.

In some aspects, the vibration-absorbing bodies 110 are fastened to the outer wall of the blower motor 100 and the engaging depressions 210 are formed in the inner surface of the motor housing 200. In some aspects, the vibration-absorbing bodies 110 may be formed to protrude from at least one part of the outer surface of the blower motor 100, and the engaging depressions 210 may be formed in the inner surface of the motor housing 200 so as to correspond to the vibration-absorbing bodies 110. For example, the vibration-absorbing bodies 110 may be mounted to part of the upper or lower surface of the blower motor 100, and the engaging depressions 210 may be formed in the inner surface of the upper or lower portion of the motor housing 200.

Figure 2:
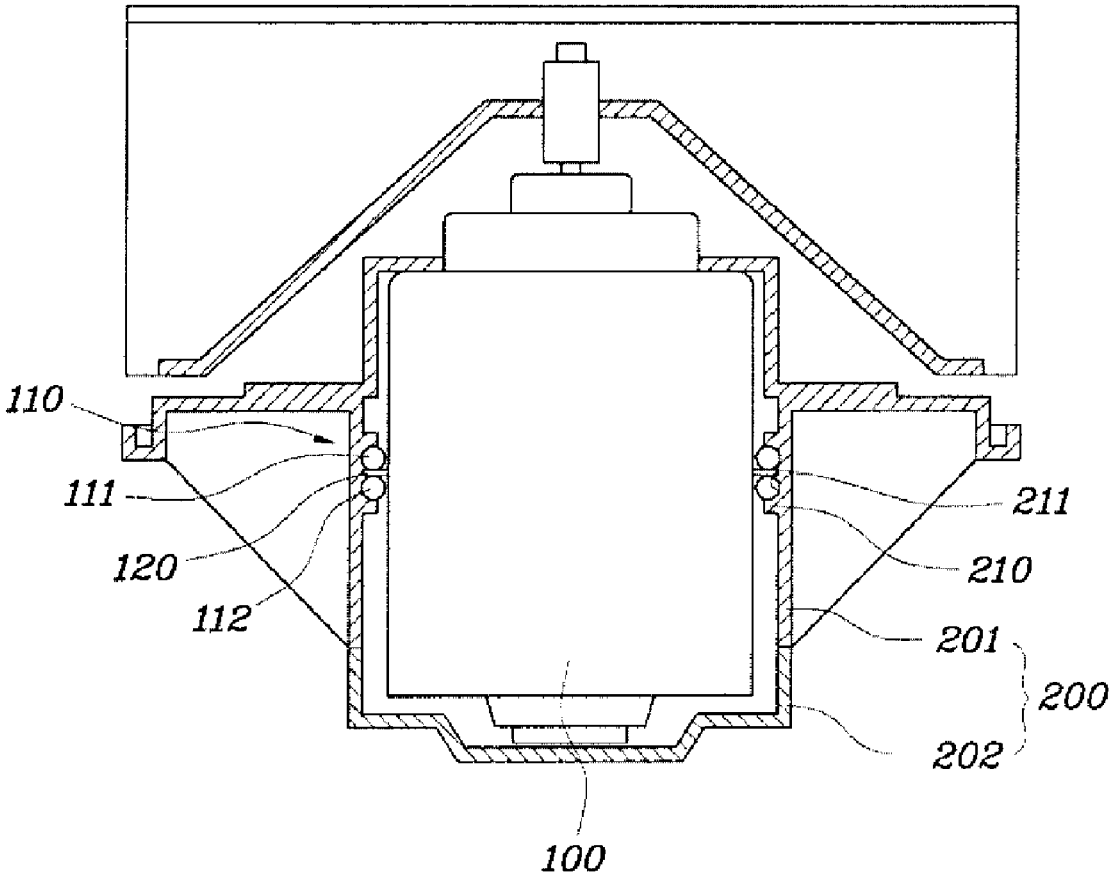
FIG. 2 is a view showing the construction of an exemplary vibration-absorbing device for a blower motor, according to various aspects of the present invention.

As shown in FIG. 2 or 3, the vibration-absorbing bodies 110 of a vibration-absorbing device for a blower motor according to various embodiments of the present invention may be configured to have a dumbbell shape. That is, each of the vibration-absorbing bodies 110 includes a first absorption ball 111, a second absorption ball 112, and a connection unit for connecting the first and second absorption balls 111 and 112 to each other.

The first and second absorption balls 111 and 112 may be formed to have a spherical shape. These first and second absorption balls 111 and 112 are contained in the engaging depressions 210 of a motor housing 200 so as to be in complete contact with the engaging depressions 210. Accordingly, all different kinds of vibration caused by the blower motor 100 can be absorbed or mitigated. In some aspects, the engaging depressions 210 may be formed to have a dumbbell shape so as to be pressed and inserted into the vibration-absorbing bodies 110, which have a dumbbell shape.

Furthermore, the connection units 113 of the respective vibration-absorbing bodies 110 are mounted to the blower motor 100 via the fitting depressions 121 of support brackets 120. Accordingly, the vibration-absorbing bodies 110 can be easily mounted to the blower motor 100.

As described above, the present invention may provide the advantages of effectively mitigating and absorbing forward, backward and lateral as well as vertical vibrations of a blower motor. As a result, the present invention may be provide the advantage of mitigating cogging noise attributable to the vibration of the blower motor.

For convenience in explanation and accurate definition in the appended claims, the terms "upper", "lower", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A vibration-absorbing device for a blower motor, the vibration-absorbing device being provided between the blower motor and a motor housing surrounding the blower motor, the vibration-absorbing device comprising:

a vibration-absorbing body affixed to the blower motor; and an engaging depression formed in an inner surface of the motor housing and receiving the vibration-absorbing body therein.

2. The vibration-absorbing device as set forth in claim 1, wherein:

the vibration-absorbing body is mounted so as to protrude from a part of an outer surface of the blower motor; and the engaging depression is formed to have a shape that corresponds to the outward shape of the vibration-absorbing body, which is pressed and inserted into the engaging depression.

3. The vibration-absorbing device as set forth in claim 2, wherein the device comprises a plurality of vibration-absorbing bodies that are spaced apart from each other and are disposed along an outer circumference of the blower motor.

4. The vibration-absorbing device as set forth in claim 2, wherein the vibration-absorbing body comprises a first absorption ball, a second absorption ball, and a connection unit for connecting the first and second absorption balls to each other.

5. The vibration-absorbing device as set forth in claim 4, wherein the blower motor comprises a support bracket into which the connection unit is fitted.

6. The vibration-absorbing device as set forth in claim 1, wherein the vibration-absorbing body is spherical.

7. A blower motor housing comprising the vibration-absorbing device as set forth in claim 1.

8. A blower motor assembly comprising a blower motor and the blower motor housing of claim 7.

* * * * *